US009237616B2

(12) United States Patent
Kim et al.

(10) Patent No.: US 9,237,616 B2
(45) Date of Patent: Jan. 12, 2016

(54) SWITCHING MODE POWER SUPPLY APPARATUS

(71) Applicant: SAMSUNG ELECTRO-MECHANICS CO., LTD., Suwon-Si, Gyeonggi-Do (KR)

(72) Inventors: Jae Kuk Kim, Daejeon-si (KR); Dong Kyun Ryu, Seoul (KR)

(73) Assignee: Samsung Electro-Mechanics Co., Ltd., Suwon-Si, Gyeonggi-Do (KR)

( * ) Notice: Subject to any disclaimer, the term of this patent is extended or adjusted under 35 U.S.C. 154(b) by 0 days.

(21) Appl. No.: 14/528,826

(22) Filed: Oct. 30, 2014

(65) Prior Publication Data

US 2015/0115838 A1 Apr. 30, 2015

(30) Foreign Application Priority Data

Oct. 31, 2013 (KR) ..... 10-2013-0131193

(51) Int. Cl.

| | |
|---|---|
| ***G05F 1/00*** | (2006.01) |
| ***H05B 37/02*** | (2006.01) |
| ***H05B 39/04*** | (2006.01) |
| ***H05B 41/36*** | (2006.01) |
| ***H05B 33/08*** | (2006.01) |

(52) U.S. Cl.

CPC ..... *H05B 33/0815* (2013.01)

(58) Field of Classification Search

None

See application file for complete search history.

(56) References Cited

U.S. PATENT DOCUMENTS

| | | | | |
|---|---|---|---|---|
| 2011/0043133 | A1 | 2/2011 | Van Laanen et al. | |
| 2012/0043892 | A1 * | 2/2012 | Visser et al. | 315/121 |
| 2014/0191659 | A1 * | 7/2014 | Wu | 315/53 |
| 2015/0035442 | A1 * | 2/2015 | Mikani et al. | 315/185 R |

FOREIGN PATENT DOCUMENTS

JP 2012-175887 A 9/2012

* cited by examiner

*Primary Examiner* — Anh Tran

(74) *Attorney, Agent, or Firm* — McDermott Will & Emery LLP

(57) ABSTRACT

A switching mode power supply apparatus includes a main transformer converting DC voltage of a predetermined amplitude supplied from a voltage source into DC voltage of a different amplitude; an auxiliary transformer operated by receiving current flowing in a primary winding of the main transformer; a first semiconductor switching element turning on/off an LED array that is driven by receiving voltage from a secondary winding of the auxiliary transformer; and an auxiliary circuit disposed in an LED control circuit unit including the LED array and the first semiconductor switching element, wherein the auxiliary circuit distributes current flowing in the first semiconductor switching element so as to reduce heat generated in the first semiconductor switching element.

5 Claims, 1 Drawing Sheet

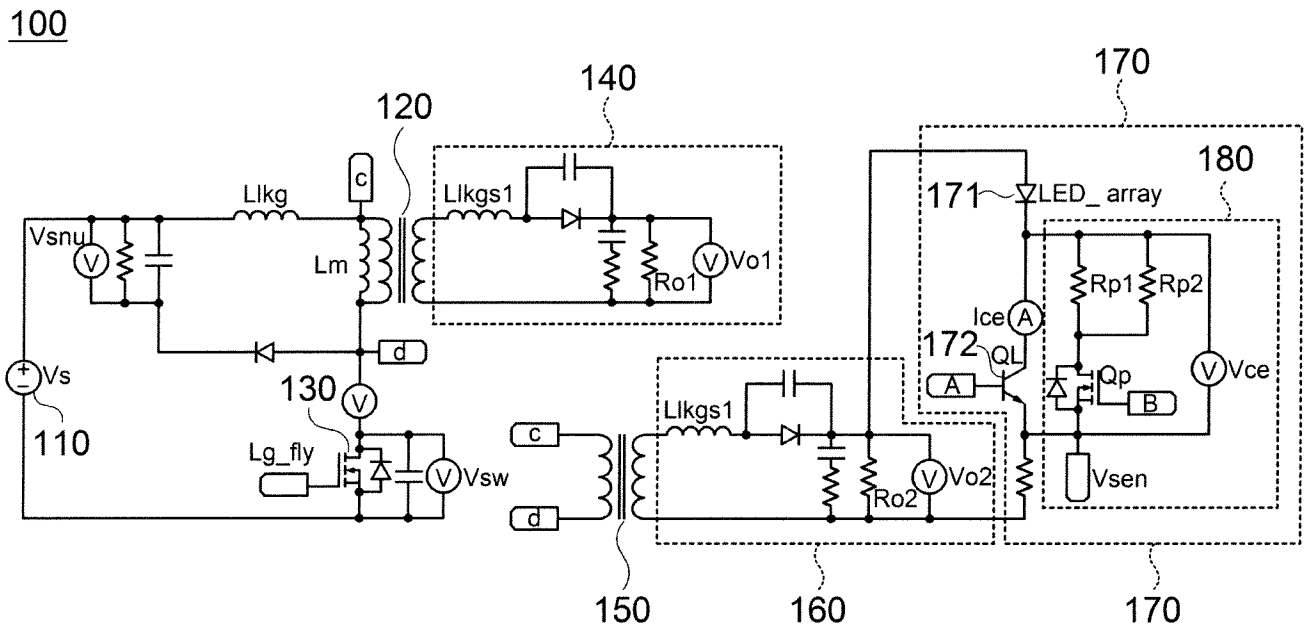
100
110
Vs
Vsnu
Llkg
Lm
120
c
d
Llkgs1
140
Vo1
Ro1
130
Vsw
Lg_fly
c
d
150
Llkgs1
160
Vo2
Ro2
170
171
LED_ array
172
Ice
QL
A
180
Rp1
Rp2
Qp
B
Vce
Vsen
170

SWITCHING MODE POWER SUPPLY APPARATUS

CROSS REFERENCE(S) TO RELATED APPLICATIONS

This application claims the foreign priority benefit under 35 U.S.C. Section 119 of Korean Patent Application Serial No. 10-2013-0131193, entitled "Switching Mode Power Supply Apparatus" filed on Oct. 31, 2013, which is hereby incorporated by reference in its entirety into this application.

BACKGROUND

1. Technical Field

The present disclosure relates to a switching mode power supply apparatus, and more particularly, to a switching mode power supply apparatus capable of reducing heat generated in a control switch (semiconductor switching element) of an LED control circuit unit.

2. Description of the Related Art

Recently, as a light emitting diode (LED) emerges as a main light source, research into an LED driver is on-going in various fields such as TVs, monitors, and lighting devices. Various types of LED drivers are used depending on applications, and in a case of multiple outputs, a boost converter connected to a main converter in series for current control and dimming is most commonly used. In addition to technology to dominate the market, research into technology to have price competitiveness is also on-going. An LED driver needs not only to regulate current to have a constant value but also to adjust brightness of light by dimming control. In this connection, there has been proposed an approach to eliminate a boost driver to regulate LED current and instead directly regulate current output from a flyback converter commonly used as a main converter, thereby improving price competitiveness of an LED driver. According to this approach, however, a current control switch is frequently turned on and off due to many variations in output voltage from the converter, such that the size of a needed heat dissipation plate becomes larger, as considerable heat is dissipated from the switch, and thus the LED driver becomes less competitive in price.

SUMMARY

An object of the present disclosure is to provide a switching mode power supply apparatus capable of reducing heat generated in a control switch (semiconductor switching element) in an LED control circuit unit by way of adding an auxiliary circuit for reducing heat in the switching element therein.

According to an exemplary embodiment, there is provided a switching mode power supply apparatus including a main transformer converting DC voltage of a predetermined amplitude supplied from a voltage source into DC voltage of a different amplitude; an auxiliary transformer operated by receiving current flowing in a primary winding of the main transformer; a first semiconductor switching element turning on/off an LED array that is driven by receiving voltage from a secondary winding of the auxiliary transformer; and an auxiliary circuit disposed in an LED control circuit unit including the LED array and the first semiconductor switching element, wherein the auxiliary circuit distributes current flowing in the first semiconductor switching element so as to reduce heat generated in the first semiconductor switching element.

The first semiconductor switching element may be a bipolar transistor.

The auxiliary circuit may be connected to the first semiconductor switching element in parallel.

The auxiliary circuit may include a plurality of resistors connected to one another in parallel; and a second semiconductor switching element connected to resistors in series so as to interrupt current flowing in the resistors.

The second semiconductor switching element may be a MOSFET.

BRIEF DESCRIPTION OF THE DRAWINGS

FIG. 1 is a circuit diagram of a switching mode power supply apparatus according to an exemplary embodiment of the present disclosure.

DESCRIPTION OF THE PREFERRED EMBODIMENTS

Terms and words used in the present specification and claims are not to be construed as a general or dictionary meaning, but are to be construed as meaning and concepts meeting the technical ideas of the present invention based on a principle that the inventors can appropriately define the concepts of terms in order to describe their own inventions in the best mode.

Throughout the present specification, unless explicitly stated otherwise, "comprising" any components will be understood to imply the inclusion of other elements rather than the exclusion of any other elements. The terms "part," "module," "device" or the like used in the specification means a unit of processing at least one function or operation and may be implemented by hardware or software or a combination of hardware and software.

Hereinafter, exemplary embodiments of the present invention will be described in detail with reference to the accompanying drawings.

FIG. 1 is a circuit diagram of a switching mode power supply apparatus according to an exemplary embodiment of the present invention.

Referring to FIG. 1, the switching mode power supply apparatus 100 according to the exemplary embodiment includes a main transformer 120, an auxiliary transformer 150, a first semiconductor switching element 172, and an auxiliary circuit 180.

The main transformer 120 converts DC voltage of a certain amplitude supplied from a voltage source 110 into DC voltage of a different amplitude. Although the voltage source 110 supplies DC voltage in this exemplary embodiment, it may also supply AC voltage (AC 110V or 220V, for example). When the AC voltage source is used, a bridge diode to rectify AC power (voltage) into DC power (voltage) may be provided next to the output terminal of the power source. The primary winding of the main transformer 120 is typically configured as a single winding, or as in this exemplary embodiment, it may be configured as double windings to which primary auxiliary winding is added for CLL resonance or power factor correction.

The auxiliary transformer 150 is operated by receiving current flowing in the primary winding of the main transformer 120. That is, the auxiliary transformer 150 receives current flowing in the primary winding of the main transformer 120 to generate a voltage with a different amplitude (induced electromotive force) through the secondary winding according to the turns ratio between the primary and secondary windings.

The first semiconductor switching element 172 (QL) turns on/off an LED array 171 that is operated by receiving power (voltage) from the secondary winding of the auxiliary transformer 150. The first semiconductor switching element 172 (QL) may be a bipolar transistor. However, the first semiconductor switching element 172 (QL) is not limited thereto and may be a MOSFET.

The auxiliary circuit 180 is provided at an LED control circuit 170 including the LED array 171 and the first semiconductor switching element 172 (QL), and serves to reduce heat generated in the first semiconductor switching element 172 (QL) by distributing current flowing in the first semiconductor switching element 172 (QL). As shown, the auxiliary circuit 180 may be connected to the first semiconductor switching element 172 (QL) in parallel.

The auxiliary circuit 180 may include a plurality of resistors Rp1, Rp2, . . . , Rpn connected to one another in parallel, and a second semiconductor switching element Qp connected to the resistors to interrupt current flowing in the resistors. The second semiconductor switching element Qp may be a MOSFET.

In FIG. 1, the element referred to by the reference numeral 130 is a switch interrupting current flowing in the primary winding of the main transformer 120, the element referred to by the reference numeral 140 is a main output voltage supplying unit supplying voltage induced in the secondary winding of the main transformer 120, and the element referred to by the reference numeral 160 is an auxiliary output voltage supplying unit supplying voltage induced in the secondary winding of the auxiliary transformer 150.

Hereinafter, the operation of the switching mode power supply apparatus thus configured according to an exemplary embodiment will be described.

When DC voltage is supplied to the main transformer 120 from the voltage source 110, the main transformer 120 converts DC voltage of a certain amplitude supplied from the voltage source 110 into DC voltage with a different amplitude according to the turns ratio between the primary winding and the secondary winding. Accordingly, the main output voltage supplying unit 140 may supply main output voltage Vo1 through its output stage.

In addition, the auxiliary transformer 150 receives current flowing in the primary winding of the main transformer 120 to generate voltage with different amplitude (induced electromotive force) through the secondary winding according to the turns ratio between the primary and secondary windings. Accordingly, the auxiliary output voltage supplying unit 160 may supply auxiliary output voltage Vo2 through its output stage.

Further, the LED control circuit unit 170 detects current flowing in a resistor Rsen, and adjusts voltage at the gate of the first semiconductor switching element 172 so that voltage across the resistor becomes constant, thereby changing voltage across the switch. Further, if dimming is necessary, the first semiconductor switching elements 172 (QL) is switched on/off according to a dimming signal, such that the first semiconductor switching elements 172 (QL) performs dimming. During the series of processes, the auxiliary output voltage Vo2 greatly fluctuates according to variations in load current of the main output voltage Vo1 or the auxiliary output voltage Vo2. Such a burden of voltage change of the auxiliary output voltage Vo2 is imparted on the first semiconductor switching element 172 (QL). That is, if controlled constant current ILED flows in the LED array 171, the voltage across the LED array 171 is substantially constant, and the voltage across the resistor Rsen is also constant. As a result, power loss occurs in the first semiconductor switching element 172 (QL), and accordingly heat is generated in the first semiconductor switching element 172 (QL).

In order to reduce heat generated in the first semiconductor switching element 172 (QL), as described above, the present disclosure provides the auxiliary circuit 180 in the LED control circuit unit 170. That is, the plurality of resistors Rp1, Rp2, . . . , Rpn is connected to the first semiconductor switching element 172 (QL) in parallel and the second semiconductor switching element Qp is connected to the resistors in series. By doing so, current flowing in the first semiconductor switching element 172 (QL) at the time of current control is distributed, such that heat generated in the first semiconductor switching element 172 (QL) may be reduced.

That is, referring to the current flowing in the first semiconductor switching element 172 (QL) as ILED, current is distributed into current equal to Vce/Rp1 flowing in the resistor Rp1, current equal to Vce/Rp2 flowing in the resistor Rp2, and current equal to Vce/Rpn flowing in the resistor Rpn. Further, power loss is created in each of the resistors accordingly. As a result, heat generated in the first semiconductor switching element 172 (QL) may be reduced.

Incidentally, the second semiconductor switching element Qp is switched on according to a "BLU ON" signal (a signal to turn an LED on), and thus is independently operated from the existing circuit and has no influence on standby power and current control.

As set forth above, the switching mode power supply apparatus according to the present disclosure includes, in an LED control circuit unit, an auxiliary circuit to reduce heat generated in a semiconductor switching element QL to turn on/off an LED array, thereby reducing heat generated in the semiconductor switching element simply and effectively.

Further, according to the present disclosure, a heat dissipation plate typically used for reducing heat generated in the semiconductor switching element can be eliminated, such that price competitiveness of the power supply apparatus can be improved.

Although the exemplary embodiments of the present invention have been disclosed for illustrative purposes, the present invention is not limited thereto, but those skilled in the art will appreciate that various modifications, additions and substitutions are possible, without departing from the scope and spirit of the invention as disclosed in the accompanying claims. Therefore, the true scope of the present invention to be protected should be defined only by the appended claims and it is apparent to those skilled in the art that technical ideas equivalent thereto are within the scope of the present invention.

What is claimed is:

1. A switching mode power supply apparatus, comprising:

a main transformer converting DC voltage of a predetermined amplitude supplied from a voltage source into DC voltage of a different amplitude;

an auxiliary transformer operated by receiving current flowing in a primary winding of the main transformer;

a first semiconductor switching element turning on/off an LED array that is driven by receiving voltage from a secondary winding of the auxiliary transformer; and an auxiliary circuit disposed in an LED control circuit unit including the LED array and the first semiconductor switching element, wherein the auxiliary circuit distributes current flowing in the first semiconductor switching element so as to reduce heat generated in the first semiconductor switching element.

2. The switching mode power supply apparatus according to claim 1, wherein the first semiconductor switching element is a bipolar transistor.

3. The switching mode power supply apparatus according to claim 1, wherein the auxiliary circuit is connected to the first semiconductor switching element in parallel.

4. The switching mode power supply apparatus according to claim 1, wherein the auxiliary circuit includes:

a plurality of resistors connected to one another in parallel; and a second semiconductor switching element connected to resistors in series so as to interrupt current flowing in the resistors.

5. The switching mode power supply apparatus according to claim 4, wherein the second semiconductor switching element is a metal-oxide semiconductor field effect transistor (MOSFET).

* * * * *